US009288584B2

(12) United States Patent
Hansen et al.

(10) Patent No.: US 9,288,584 B2
(45) Date of Patent: Mar. 15, 2016

(54) HEARING AID FOR PROVIDING PHONE SIGNALS

(71) Applicant: GN ReSound A/S, Ballerup (DK)

(72) Inventors: Kim Heegaard Hansen, Tune (DK); Brian Dam Pedersen, Ringsted (DK)

(73) Assignee: GN RESOUND A/S, Ballerup (DK)

( * ) Notice: Subject to any disclaimer, the term of this patent is extended or adjusted under 35 U.S.C. 154(b) by 481 days.

(21) Appl. No.: 13/654,144

(22) Filed: Oct. 17, 2012

(65) Prior Publication Data

US 2014/0086417 A1 Mar. 27, 2014

(30) Foreign Application Priority Data

Sep. 25, 2012 (DK) ..... 2012 70584
Sep. 25, 2012 (EP) ..... 12185952

(51) Int. Cl.
*H04R 25/00* (2006.01)

(52) U.S. Cl.
CPC ..... *H04R 25/00* (2013.01); *H04R 25/43* (2013.01); *H04R 25/407* (2013.01); *H04R 25/552* (2013.01); *H04R 25/554* (2013.01); *H04R 25/70* (2013.01); *H04R 2225/021* (2013.01); *H04R 2225/41* (2013.01); *H04R 2225/61* (2013.01)

(58) Field of Classification Search
CPC ..... H04R 2225/61; H04R 2430/01; H04R 2225/41
USPC ..... 381/313, 315, 74, 321
See application file for complete search history.

(56) References Cited

U.S. PATENT DOCUMENTS

| | | | | |
|---|---|---|---|---|
| 6,594,366 | B1 * | 7/2003 | Adams | 381/74 |
| 7,245,730 | B2 | 7/2007 | Enzmann | |
| 7,248,713 | B2 | 7/2007 | Bren et al. | |
| 7,447,325 | B2 | 11/2008 | Bren et al. | |
| 2003/0044033 | A1 * | 3/2003 | Julstrom et al. | 381/315 |

(Continued)

FOREIGN PATENT DOCUMENTS

| | | | |
|---|---|---|---|
| CN | 101472215 | A | 7/2009 |
| CN | 102215446 | A | 10/2011 |

(Continued)

OTHER PUBLICATIONS

First Technical Examination and Search Report dated Mar. 15, 2013 for Danish Patent Application No. PA 2012 70584.

(Continued)

*Primary Examiner* — Alexander Jamal
(74) *Attorney, Agent, or Firm* — Vista IP Law Group, LLP

(57) ABSTRACT

A hearing system includes a first hearing aid, the first hearing aid comprising: a first microphone for converting sound into electrical signals; a processor communicatively coupled to the first microphone, wherein the processor is configured to provide an output based on the electrical signals from the first microphone; a first speaker communicatively coupled to the processor, and is configured to provide an acoustic signal based on the output provided by the processor; and a first communication device configured to receive a control signal transmitted from a second hearing aid in response to a reception or detection of a signal associated with a phone by the second hearing aid; wherein the first hearing aid is configured to reduce a gain of the first hearing aid to a non-zero value in response to the control signal received from the second hearing aid.

55 Claims, 4 Drawing Sheets

(56) References Cited

U.S. PATENT DOCUMENTS

| | | | | |
|---|---|---|---|---|
| 2004/0052391 | A1 | 3/2004 | Bren et al. | |
| 2005/0117764 | A1 | 6/2005 | Arndt et al. | |
| 2008/0253595 | A1 | 10/2008 | Steinbuss | |
| 2009/0052707 | A1 | 2/2009 | Hain | |
| 2009/0154742 | A1 | 6/2009 | Rasmussen | |
| 2011/0135126 | A1* | 6/2011 | Gozen | 381/313 |

FOREIGN PATENT DOCUMENTS

| | | | |
|---|---|---|---|
| EP | 1 251 714 | A2 | 10/2002 |
| EP | 1379103 | A2 | 1/2004 |
| EP | 2071874 | A1 | 6/2009 |
| WO | 2012/084026 | A1 | 6/2012 |

OTHER PUBLICATIONS

Chinese Notification of First Office action dated Nov. 4, 2014, for related CN Patent Application No. 201310445700.7, 12 pages.

Danish Second Technical Examination dated Oct. 14, 2013, for related DK Patent Application No. PA 2012 70584, 3 pages.

* cited by examiner

HEARING AID FOR PROVIDING PHONE SIGNALS

RELATED APPLICATION DATA

This application claims priority to and the benefit of Danish Patent Application No. PA 2012 70584, filed on Sep. 25, 2012, pending, and European Patent Application No. 12185952, filed on Sep. 25, 2012, pending, the entire disclosures of both of which are expressly incorporated by reference herein.

FIELD

This application relates generally to hearing aid, and more specifically, to binaural hearing system that includes a first hearing aid and a second hearing aid.

BACKGROUND

A binaural hearing system generally includes a first hearing aid for wear at a first ear of a user, and a second hearing aid for wear at a second ear of the user. The binaural hearing system may be configured to address a hearing loss of the user.

Applicant of the subject application determines that it would be desirable to have a binaural hearing system that is capable of processing phone conversation signal, such as when the user of the binaural hearing system picks up a phone. Applicant of the subject application also determines that it would be desirable for such binaural hearing system to continue providing acoustic signal representing environmental sound to the user even when the user is engaging with a phone conversation.

SUMMARY

In accordance with some embodiments, a hearing system includes a first hearing aid, the first hearing aid includes: a first microphone for converting sound into electrical signals; a processor communicatively coupled to the first microphone, wherein the processor is configured to provide an output based on the electrical signals from the first microphone; a first speaker communicatively coupled to the processor, and is configured to provide an acoustic signal based on the output provided by the processor; and a first communication device configured to receive a control signal transmitted from a second hearing aid in response to a reception or detection of a signal associated with a phone by the second hearing aid; wherein the first hearing aid is configured to reduce a gain of the first hearing aid to a non-zero value in response to the control signal received from the second hearing aid.

In one or more embodiments, the first hearing aid is configured to be switched to an omnidirectional mode in response to the control signal.

In one or more embodiments, the first microphone of the first hearing aid remains on after the first communication device of the first hearing aid receives the control signal from the second hearing aid.

In one or more embodiments, the first speaker of the first hearing aid is configured to provide the acoustic signal based on the output provided by the processor regardless of whether the first communication device of the first hearing aid receives the control signal from the second hearing aid or not.

In one or more embodiments, the first hearing aid is configured to provide acoustic signals representative of phone signals from the phone in response to the control signal received from the second hearing aid.

In one or more embodiments, the hearing system further includes the second hearing aid, wherein in response to the signal associated with the phone, only the second hearing aid, and not the first hearing aid, provides acoustic signals representative of phone signals from the phone.

In one or more embodiments, an amount of gain reduction is adjustable. For example, the amount of gain reduction may be adjustable by a user using a control at one or both of the first and second hearing aids. In another example, the amount of gain reduction may be adjustable by a technician during a hearing aid fitting process. In such cases, the amount of gain reduction may be adjustable and preset to a certain value.

In one or more embodiments, the hearing system further includes a control for allowing a user of the hearing system to adjust an amount of gain reduction of the first hearing aid.

In one or more embodiments, an amount of gain reduction of the first hearing aid is based on a preset user preference.

In one or more embodiments, an amount of gain reduction of the first hearing aid is based on a hearing loss of a user of the hearing system.

In one or more embodiments, an amount of gain reduction of the first hearing aid is dependent on an environment in which the hearing system is operated.

In one or more embodiments, an amount of gain reduction of the first hearing aid is frequency dependent.

In one or more embodiments, the first communication device comprises a wire for receiving the control signal.

In one or more embodiments, the first communication device comprises a wireless component for receiving the control signal.

In one or more embodiments, the hearing system further includes the second hearing aid, the second hearing aid comprising: a component for receiving or detecting the signal associated with the phone; and a second communication device communicatively coupled to the component, wherein the second communication device is configured to transmit the control signal to the first hearing aid in response to the signal received or detected by the component.

In one or more embodiments, the component comprises a sensor for detecting a magnetic field as the signal that is associated with the phone.

In one or more embodiments, the magnetic field is from a permanent magnet.

In one or more embodiments, the magnetic field is from an electro-magnetic coil.

In one or more embodiments, the component comprises a signal receiver configured to receive radiofrequency signal from the phone.

In one or more embodiments, the component comprises a signal receiver configured to receive Bluetooth signal from the phone.

In one or more embodiments, the second hearing aid is configured to operate in a first mode and in a second mode, the second hearing aid having a second speaker; wherein in the first mode, the second speaker of the second hearing aid provides an acoustic signal that represents environmental sound; and wherein in the second mode, the second speaker of the second hearing aid provides an acoustic signal that represents phone signal.

In one or more embodiments, when in the second mode, the acoustic signal that represents the phone signal is derived from an acoustic phone signal provided from a speaker of the phone.

In one or more embodiments, when in the second mode, the acoustic signal that represents the phone signal is derived from an induction signal from the phone.

In one or more embodiments, the first hearing aid is also configured to increase the gain of the first hearing aid in response to an additional control signal transmitted by the second hearing aid, the additional control signal transmitted by the second hearing aid in response to a lack of reception or detection of the signal associated with the phone.

In one or more embodiments, a hearing aid fitting system for fitting the hearing system to compensate for a hearing loss of a user includes a user interface for receiving an input to set an amount of gain reduction of the first hearing aid.

In accordance with other embodiments, a hearing system includes a first hearing aid, the first hearing aid includes: a first microphone for converting sound into electrical signals; a component for receiving or detecting a signal associated with a phone; a processor communicatively coupled to the first microphone, wherein the processor is configured to provide an output based on the electrical signals from the first microphone; a first speaker communicatively coupled to the processor, and is configured to provide an acoustic signal based on the output provided by the processor; and a first communication device communicatively coupled to the component, wherein the communication device is configured to transmit a control signal to a second hearing aid to reduce a gain of the second hearing aid to a non-zero value in response to the signal received or detected by the component.

In one or more embodiments, the hearing system further includes the second hearing aid, wherein the second hearing aid comprises: a second communication device configured to receive the control signal transmitted from the first communication device of the first hearing aid; and circuitry for reducing the gain of the second hearing aid in response to the control signal.

In one or more embodiments, the control signal also switches the second hearing aid into an omnidirectional mode.

In one or more embodiments, the hearing system further includes the second hearing aid, wherein the second hearing aid comprises: a second communication device configured to receive the control signal transmitted from the first communication device of the first hearing aid; and circuitry for reducing the gain of the second hearing aid in response to the control signal, and for switching the second hearing aid into the omnidirectional mode in response to the control signal.

In one or more embodiments, the hearing system further includes the second hearing aid, the second hearing aid comprising a second microphone and a second speaker, wherein the second microphone of the second hearing aid remains on after the second hearing aid receives the control signal from the first hearing aid.

In one or more embodiments, the hearing system further includes the second hearing aid, the second hearing aid comprising a second microphone and a second speaker, wherein the second speaker of the second hearing aid is configured to provide an acoustic signal based on an output from the second microphone regardless of whether the second hearing aid receives the control signal from the first hearing aid or not.

In one or more embodiments, the hearing system further includes the second hearing aid, wherein the second hearing aid is configured to provide acoustic signals representative of phone signals from the phone in response to the control signal received from the first hearing aid.

In one or more embodiments, the hearing system further includes the second hearing aid, wherein in response to the signal associated with the phone, only the first hearing aid, and not the second hearing aid, provides acoustic signals representative of phone signals from the phone.

In one or more embodiments, an amount of gain reduction of the second hearing aid is adjustable. For example, the amount of gain reduction may be adjustable by a user using a control at one or both of the first and second hearing aids. In another example, the amount of gain reduction may be adjustable by a technician during a hearing aid fitting process. In such cases, the amount of gain reduction may be adjustable and preset to a certain value.

In one or more embodiments, the hearing system further includes a control for allowing a user of the hearing system to adjust an amount of gain reduction of the second hearing aid.

In one or more embodiments, an amount of gain reduction of the second hearing aid is based on a preset user preference.

In one or more embodiments, an amount of gain reduction of the second hearing aid is based on a hearing loss of a user of the hearing system.

In one or more embodiments, an amount of gain reduction of the second hearing aid is dependent on an environment in which the hearing system is operated.

In one or more embodiments, an amount of gain reduction of the second hearing aid is frequency dependent.

In one or more embodiments, the component comprises a sensor for detecting a magnetic field as the signal that is associated with the phone.

In one or more embodiments, the magnetic field is from a permanent magnet.

In one or more embodiments, the magnetic field is from an electro-magnetic coil.

In one or more embodiments, the component comprises a signal receiver configured to receive radiofrequency signal from the phone.

In one or more embodiments, the component comprises a signal receiver configured to receive Bluetooth signal from the phone.

In one or more embodiments, the first communication device comprises a wire for transmitting the control signal.

In one or more embodiments, the first communication device comprises a wireless component for transmitting the control signal.

In one or more embodiments, the first hearing aid is configured to operate in a first mode and in a second mode; wherein in the first mode, the first speaker provides the acoustic signal that represents environmental sound; and wherein in the second mode, the first speaker provides an output that represents phone signal.

In one or more embodiments, when in the second mode, the output that represents the phone signal is derived from an acoustic phone signal provided from a speaker of the phone.

In one or more embodiments, when in the second mode, the output that represents the phone signal is derived from an induction signal from the phone.

In one or more embodiments, the first communication device of the first hearing aid is also configured to transmit an additional control signal to the second hearing aid to increase the gain of the second hearing aid in response to a lack of reception or detection of the signal associated with the phone.

In one or more embodiments, a hearing aid fitting system for fitting the hearing system to compensate for a hearing loss of a user includes a user interface for receiving an input to set an amount of gain reduction of the second hearing aid.

In accordance with other embodiments, a hearing system includes a first hearing aid, the first hearing aid comprising: a first microphone for converting sound into electrical signals; a processor communicatively coupled to the first microphone, wherein the processor is configured to provide an output based on the electrical signals from the first microphone; a first speaker communicatively coupled to the processor, and is configured to provide an acoustic signal based on the output provided by the processor; and a first communication device configured to receive a control signal transmitted from a second hearing aid in response to a lack of reception or detection of a signal associated with a phone; wherein the first hearing aid is configured to increase a gain of the first hearing aid in response to the control signal received from the second hearing aid.

In accordance with other embodiments, a hearing system includes a first hearing aid, the first hearing aid comprising: a first microphone for converting sound into electrical signals; a component for receiving or detecting a signal associated with a phone; a processor communicatively coupled to the first microphone, wherein the processor is configured to provide an output based on the electrical signals from the first microphone; a first speaker communicatively coupled to the processor, and is configured to provide an acoustic signal based on the output provided by the processor; and a first communication device communicatively coupled to the component, wherein the communication device is configured to transmit a control signal to a second hearing aid to increase a gain of the second hearing aid in response to a lack of reception or detection of the signal by the component.

In accordance with other embodiments, a hearing aid includes: a microphone for converting sound into electrical signals; a processor communicatively coupled to the microphone, wherein the processor is configured to provide an output based on the electrical signals from the microphone; a speaker communicatively coupled to the processor, and is configured to provide an acoustic signal based on the output provided by the processor; and a communication device configured to receive a control signal transmitted from a phone or a phone accessory; wherein the hearing aid is configured to detect whether it is located at a position contralateral to a position of the phone with respect to a head of a user; and wherein the processor is configured to reduce a gain of the hearing aid to a non-zero value in response to the control signal received from the phone or the phone accessory.

In one or more embodiments, the control signal is from the phone accessory, and the phone accessory comprises a Bluetooth bridging device.

Other and further aspects and features will be evident from reading the following detailed description of the embodiments.

BRIEF DESCRIPTION OF THE DRAWINGS

The drawings illustrate the design and utility of embodiments, in which similar elements are referred to by common reference numerals. These drawings are not necessarily drawn to scale. In order to better appreciate how the above-recited and other advantages and objects are obtained, a more particular description of the embodiments will be rendered, which are illustrated in the accompanying drawings. These drawings depict only typical embodiments and are not therefore to be considered limiting of its scope.

DESCRIPTION OF THE EMBODIMENTS

Figure 1:
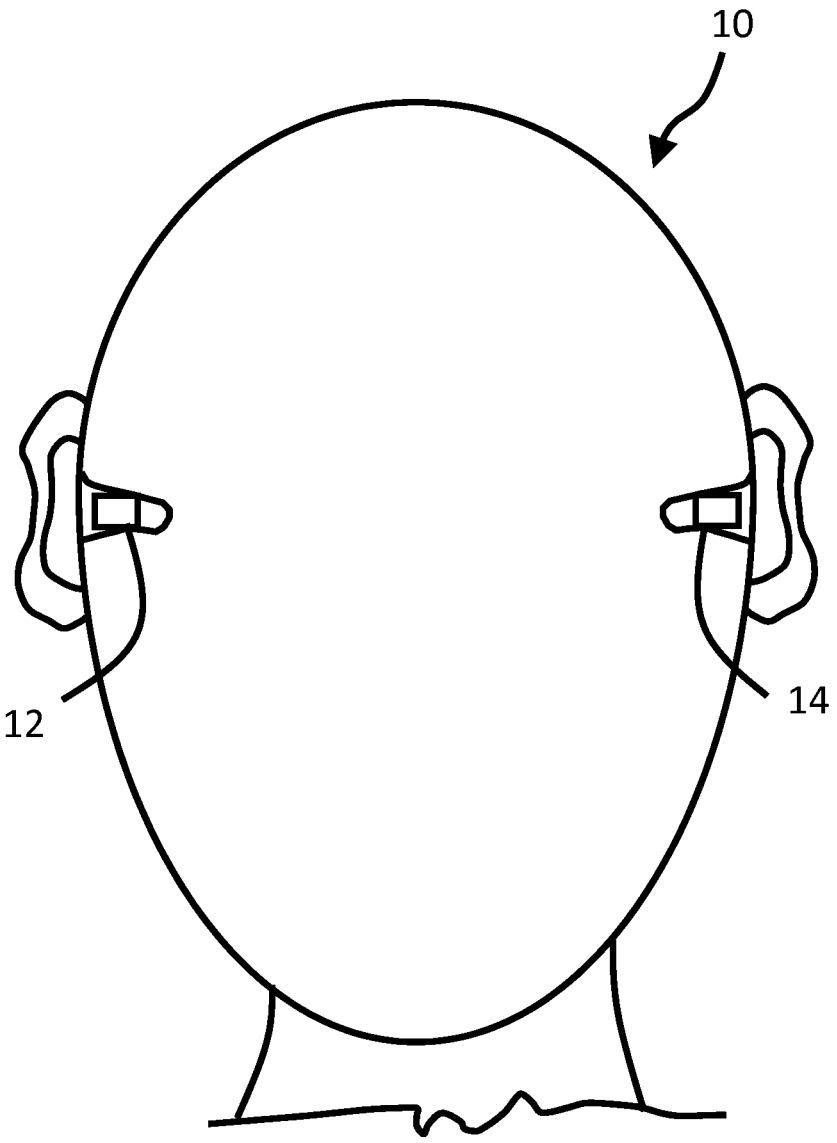
FIG. 1 illustrates a binaural hearing system in accordance with some embodiments.

Various embodiments are described hereinafter with reference to the figures. It should be noted that the figures are not drawn to scale and that elements of similar structures or functions are represented by like reference numerals throughout the figures. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

FIG. 1 illustrates a binaural hearing system 10 in accordance with some embodiments. The binaural hearing system 10 includes a first hearing aid 12 and a second hearing aid 14 for placement at respective ears of a user of the binaural hearing system 10. Although the hearing aids 12, 14 as shown as being placed completely in the respective ear canals, in other embodiments, the hearing aids 12, 14 may be configured to be inserted partially in the respective ear canals. In further embodiments, the hearing aids 12, 14 may be configured for placement outside the respective ear canals. Also, in other embodiments, each of the hearing aids 12, 14 may be a behind-the-ear (BTE) device. In further embodiments, the hearing aids 12, 14 may be parts of a headset with a headband that connects the hearing aids 12, 14.

Figure 2:
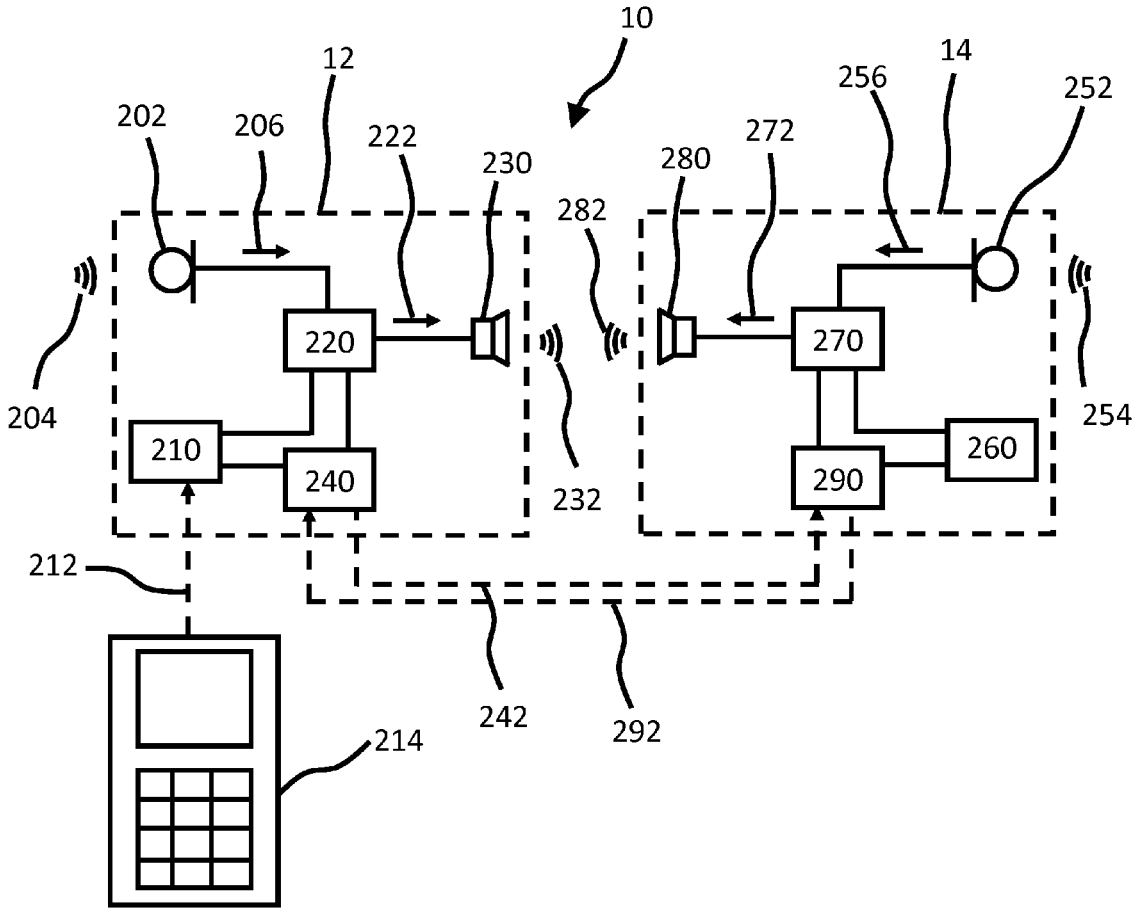
FIG. 2 illustrates one implementation of the binaural hearing system of FIG. 1 in accordance with some embodiments.

FIG. 2 illustrates an implementation of the binaural hearing system 10 of FIG. 1 in accordance with some embodiments. As shown in the figure, the first hearing aid 12 includes a first microphone 202 for converting environmental sound (i.e., surrounding sound in the environment in which the hearing aid is being operated) 204 into electrical signals 206, a first component 210 for receiving or detecting a signal 212 associated with a phone 214, and a first processor 220 communicatively coupled to the first microphone 202. The first processor 220 is configured to provide an output 222 based on the electrical signals 206 from the first microphone 202. The first hearing aid 12 also includes a first speaker 230 communicatively coupled to the first processor 220, and is configured to provide an acoustic signal 232 based on the output 222 provided by the first processor 220. As shown in the figure, the first hearing aid 12 further includes a first communication device 240 communicatively coupled to the component 210. The first communication device 240 is configured to transmit a control signal 242 to the second hearing aid 14 to reduce a gain of the second hearing aid 14 to a non-zero value in response to the signal 212 detected by the component 210 (i.e., when the phone is placed next to the ear wearing the first hearing aid 14). In some embodiments, the gain that is reduced may be the gain from the microphone to the speaker of the second hearing aid 14.

In the illustrated embodiments, the second hearing aid 14 includes a second microphone 252 for converting sound 254 into electrical signals 256, a second component 260 for receiving or detecting the signal 212 associated with the phone 214 when the phone 214 is placed next to the ear wearing the second hearing aid 14, and a second processor 270 communicatively coupled to the second microphone 252. The second processor 270 is configured to provide an output 272 based on the electrical signals 256 from the second microphone 252. The second hearing aid 14 also includes a second speaker 280 communicatively coupled to the second processor 270, and is configured to provide an acoustic signal 282 based on the output 272 provided by the second processor 270. As shown in the figure, the second hearing aid 14 further includes a second communication device 290 communicatively coupled to the component 260. The communication device 240 is configured to transmit a control signal 292 to the first hearing aid 12 to reduce a gain of the first hearing aid 12 to a non-zero value in response to the signal 212 detected by the component 260 (i.e., when the phone is placed next to the ear wearing the second hearing aid 14).

In some embodiments, the first processor 220 may be any component having circuitry that is capable of performing signal processing. For example, in some embodiments, the first processor 220 may be any type of processor, including but not limited to a general purpose processor, an ASIC processor, a FPGA processor, etc. (each of which may be considered an example of circuitry). In other embodiments, the first processor 220 may be any hardware (e.g., circuitry) configured for signal processing. Furthermore, the first processor 220 may be implemented using a single component, or multiple components (e.g., processing modules) in some embodiments.

Similarly, in some embodiments, the second processor 270 may be any component having circuitry that is capable of performing signal processing. For example, in some embodiments, the second processor 270 may be any type of processor, including but not limited to a general purpose processor, an ASIC processor, a FPGA processor, etc. (each of which may be considered an example of circuitry). In other embodiments, the second processor 270 may be any hardware (e.g., circuitry) configured for signal processing. Furthermore, the second processor 270 may be implemented using a single component, or multiple components (e.g., processing modules) in some embodiments.

Also, in some embodiments, the first hearing aid 12 may include circuitry for reducing the gain of the first hearing aid 12. The circuitry may be implemented using the first processor 220 (e.g., it may be a part of the first processor 220, such as a processing module in the first processor 220), or it may be implemented using other component(s). Similarly, in some embodiments, the second hearing aid 14 may include circuitry for reducing the gain of the second hearing aid 14. The circuitry may be implemented using the second processor 270 (e.g., it may be a part of the second processor 270, such as a processing module in the second processor 270), or it may be implemented using other component(s).

In one method of use of the binaural hearing system 10, the first and second hearing aids 12, 14 are placed in respective ears of a user of the binaural hearing system 10. In a first mode of operation by the first hearing aid 12, the first microphone 202 receives sound 204 from the environment, and covert the sound 204 into electrical signals 206 for processing by the first processor 220. The first processor 220 processes the electrical signals 206 in accordance with a hearing compensation algorithm specific for the user of the hearing system 10, and generates an output (or hearing compensated output) 222. The first speaker 230 receives the output 222 and converts the output 222 into the acoustic signals (or hearing compensated acoustic signals) 232 for emission towards a first eardrum of the ear of the user wearing the first hearing aid 12. In some embodiments, the hearing compensation algorithm may include a hearing compensation program running on the first processor 220, and hearing compensation parameters stored in a non-transitory medium in the first hearing aid 12.

Similarly, in the first mode of operation by the second hearing aid 14, the first microphone 252 receives sound 254 from the environment, and covert the sound 254 into electrical signals 256 for processing by the second processor 270. The second processor 270 processes the electrical signals 256 in accordance with a hearing compensation algorithm specific for the user of the hearing system 10, and generates an output (or hearing compensated output) 272. The second speaker 280 receives the output 272 and converts the output 272 into the acoustic signals (or hearing compensated acoustic signals) 282 for emission towards an eardrum of a second ear of the user wearing the second hearing aid 14. In some embodiments, the hearing compensation algorithm may include a hearing compensation program running on the second processor 270, and hearing compensation parameters stored in a non-transitory medium in the second hearing aid 14.

Figure 3:
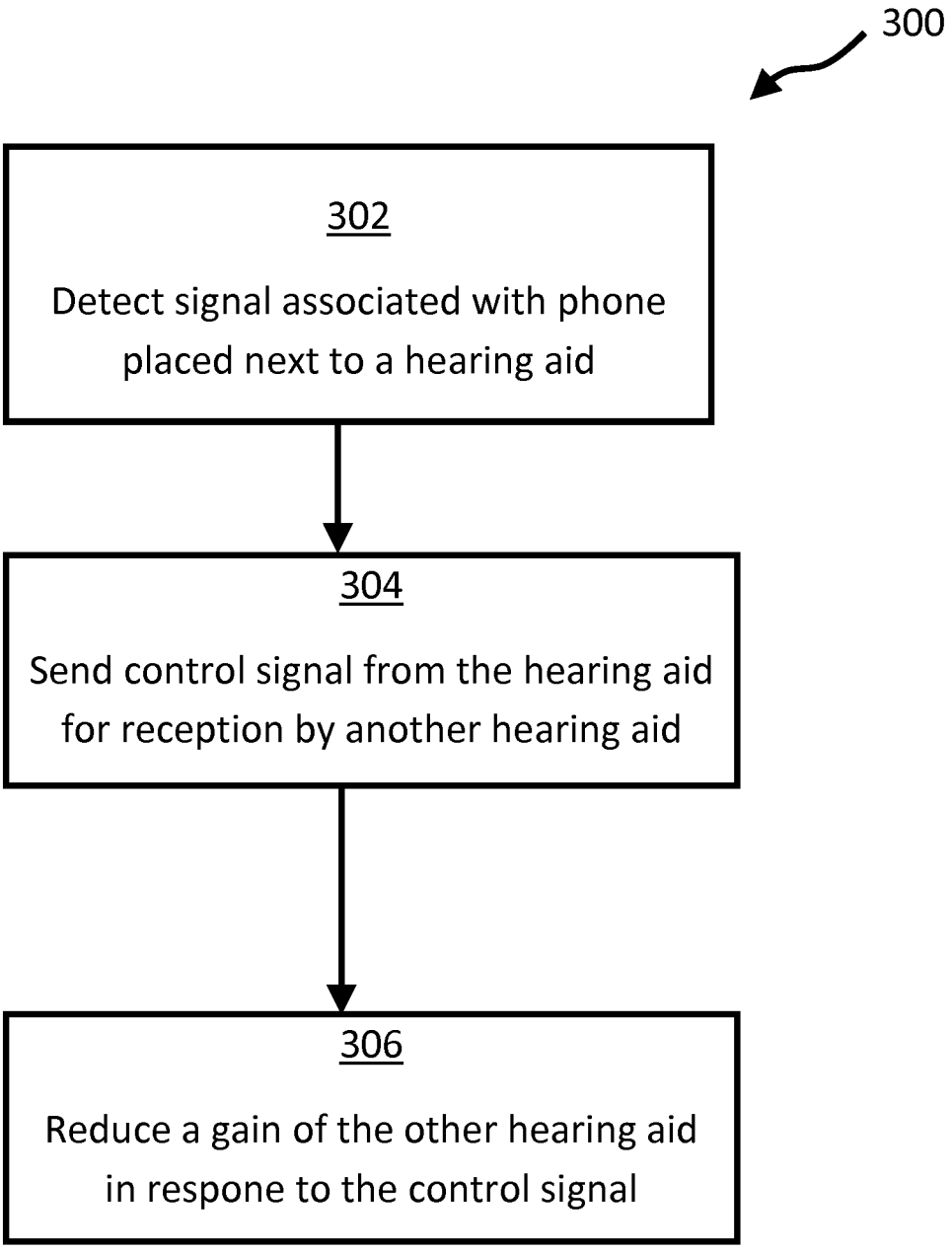
FIG. 3 illustrates a method performed by a binaural hearing system in accordance with some embodiments.

In some cases, when the user of the hearing system 10 picks up the phone 214, and places the phone 214 next to the first ear (for example) wearing the first hearing aid 12 to make a call, or to answer a call, the component 210 at the first hearing aid 12 detects the signal 212 that is associated with the phone 214 (See item 302 in FIG. 3, which illustrates a method 300 performed by the hearing system 10 in some embodiments). This places the hearing system 10 into a second mode of operation. In the second mode, in response to the detection of the signal 212 by the component 210, the communication device 240 in the first hearing aid 12 transmits the control signal 242 to the second hearing aid 14 (Item 304). The communication device 290 in the second hearing aid 14 receives the signal 242 from the first hearing aid 12. The second processor 270 in the second hearing aid 14, in response to the detected signal 242, reduces a gain of the second hearing aid 14 to a non-zero value (Item 306). In some embodiments, the reducing of the gain of the second hearing aid 14 may be accomplished by reducing a voltage or current for the second speaker 280 to thereby reduce a volume of the acoustic signal 282 being output by the second speaker 280. In other embodiments, the reducing of the gain of the second hearing aid 14 may be accomplished by reducing a sensitivity of the second microphone 252, and/or an energy level of the signal 256 being output by the second microphone 252. For example, in some embodiments, the microphone signal may be reduced by 6 db, or any of other prescribed values.

Thus, as shown in the illustrated example, when the user is using the phone 214 in the first ear wearing the first hearing aid 12, the second hearing aid 14 is still being used to process sound 254 from the environment. In particular, the second microphone 260 remains "ON", and the second speaker 280 of the second hearing aid 14 is configured to provide the acoustic signal 282 based on the signal 256 from the second microphone 252 regardless of whether the second hearing aid 14 receives the control signal 242 from the first hearing aid 12 or not. However, the acoustic signal 282 output by the second speaker 280 of the second hearing aid 14 is reduced so that the user can focus on the phone call at the first ear, while maintain the ability to hear environmental sound using the second hearing aid 14. This is advantageous in that the user may want to be aware of his/her surrounding while speaking on the phone 214. For example, the user may want to know if another person is walking up to the user, or calling on the user from nearby surrounding environment, while the user is on the phone 214. As another example, the user may want to know if a car is approaching while speaking on the phone 214. Allowing the user to be aware of his/her surrounding may provide safety for the user and make the user feel more comfortable using the phone feature of the hearing system 10, and it may also allow the user to perform other task(s) that involve the user being aware of the surrounding environment. Furthermore, when the second microphone at one ear is remained on (i.e., not turned off while the first microphone at the other ear processes audio signals from the phone), the second hearing aid can process environmental sounds, thereby providing a true binaural functionality. The above features are counter-intuitive and are non-obvious because one may consider having mixed signals (i.e., phone signal at one ear plus signal from the environment at the other ear) undesirable since a user may be annoyed by the mixed signals. However, Applicant of the subject application believes that while the mixed signals may provide some degree of annoyance, the benefit of being aware of the surrounding environment may outweigh such annoyance.

In some embodiments, an amount of gain reduction of the second hearing aid 14 may be fixed. In other embodiments, an amount of gain reduction of the second hearing aid 14 is based on user preference. For example, one or each of the hearing aids 12, 14 may include a control for allowing the user to select the amount of gain reduction. The control may be in a form of a button or a knob, or alternatively, in the form of a programming interface. In other embodiments, the amount of gain reduction of the second hearing aid 14 may be based on a hearing loss of the user of the hearing system 10. In such cases, the amount of gain reduction may be determined during a hearing or fitting test. In further embodiments, the amount of gain reduction of the second hearing aid 14 may be dependent on an environment in which the hearing system 10 is operated. For example, in one implementation, the amount of gain reduction of the second hearing aid 14 may be frequency dependent. In such cases, the amount of gain reduction may be a function of a frequency range associated with sound from the environment. In another implementation, the second hearing aid 14 may include an environment classifier, which classifies the environment in which the hearing system 10 is being operated. If the environment classifier determines that the environment is a noisy place, the amount of gain reduction may be less. On the other hand, if the environment classifier determines that the environment is a quiet place, the amount of gain reduction may be relatively higher.

In some embodiments, in addition to reducing the gain of the second hearing aid 14, the second processor 270 may also be configured to place the second hearing aid 14 in an omnidirectional mode in response to the signal 242 detected by the second communication device 290. For example, the second processor 270 may switch the second hearing aid 14 from a directional mode to an omnidirectional mode.

Alternatively, in another method of use, instead of placing the phone 214 next to the first ear, the user may place the phone 214 next to the second ear wearing the second hearing aid 14. In such cases, when the user of the hearing system 10 places the phone 214 next to the second ear wearing the second hearing aid 14 to make a call, or to answer a call, the component 260 at the second hearing aid 14 detects the signal 212 that is associated with the phone 214 (Item 302). This places the hearing system 10 into a second mode of operation. In the second mode, in response to the detection of the signal 212 by the component 260, the communication device 290 in the second hearing aid 14 transmits the signal 292 to the first hearing aid 12 (Item 304). The communication device 240 in the first hearing aid 12 receives the signal 292 from the second hearing aid 14. The first processor 220 in the first hearing aid 12, in response to the detected signal 292, reduces a gain of the first hearing aid 12 to a non-zero value (Item 306). In some embodiments, the reducing of the gain of the first hearing aid 12 may be accomplished by reducing a voltage or current for the first speaker 230 to thereby reduce a volume of the acoustic signal 232 being output by the first speaker 230. In other embodiments, the reducing of the gain of the first hearing aid 12 may be accomplished by reducing a sensitivity of the first microphone 202, and/or an energy level of the signal 206 being output by the first microphone 202. For example, in some embodiments, the microphone signal may be reduced by 6 db, or any of other prescribed values.

Thus, as shown in the illustrated example, when the user is using the phone 214 in the second ear wearing the second hearing aid 14, the first hearing aid 12 is still being used to process sound 204 from the environment. In particular, the first microphone 202 remains "ON", and the second speaker 230 of the first hearing aid 12 is configured to provide the acoustic signal 232 based on the signal 206 from the first microphone 202 regardless of whether the first hearing aid 12 receives the control signal 292 from the second hearing aid 14 or not. However, the acoustic signal 232 output by the first speaker 230 of the first hearing aid 12 is reduced so that the user can focus on the phone call at the second ear, while maintain the ability to hear environmental sound using the first hearing aid 12.

In some embodiments, an amount of gain reduction of the first hearing aid 12 may be fixed. In other embodiments, an amount of gain reduction of the first hearing aid 12 is based on user preference. For example, one or each of the hearing aids 12, 14 may include a control for allowing the user to select the amount of gain reduction. The control may be in a form of a button or a knob, or alternatively, in the form of a programming interface. In other embodiments, the amount of gain reduction of the first hearing aid 12 may be based on a hearing loss of the user of the hearing system 10. In such cases, the amount of gain reduction may be determined during a hearing or fitting test. In further embodiments, the amount of gain reduction of the first hearing aid 12 may be dependent on an environment in which the hearing system 10 is operated. For example, in one implementation, the amount of gain reduction of the first hearing aid 12 may be frequency dependent. In such cases, the amount of gain reduction may be a function of a frequency range associated with sound from the environment. In another implementation, the first hearing aid 12 may include an environment classifier, which classifies the environment in which the hearing system 10 is being operated. If the environment classifier determines that the environment is a noisy place, the amount of gain reduction may be less. On the other hand, if the environment classifier determines that the environment is a quiet place, the amount of gain reduction may be relatively higher. Also, in some embodiments, the amount of gain reduction may be the same for the first and second hearing aids 12, 14. In other embodiments, the amount of gain reduction of the first hearing aid 12 may be different from an amount of gain reduction of the second hearing aid 14.

In some embodiments, in addition to reducing the gain of the first hearing aid 12, the first processor 220 may also be configured to place the first hearing aid 12 in an omnidirectional mode in response to the signal 292 detected by the first communication device 240. For example, the first processor 220 may switch the first hearing aid 12 from a directional mode to an omnidirectional mode.

In some embodiments, the signal 212 associated with the phone 214 may be a magnetic field from a static (permanent) magnetic coil in the phone 214, in which cases, the components 210, 260 may be respective magnetic field sensors. Alternatively, the magnetic field may be from a permanent magnet that is attached to the phone 214. In other embodiments, the signal 212 may be an electromagnetic field from a magnetic coil in the phone 214, in which cases, the components 210, 260 may be respective magnetic field sensors configured to detect electromagnetic fields. The magnetic coil may be a part of a speaker of the phone 214 in some embodiments. In further embodiments, the signal 212 may be a radiofrequency signal, in which cases, the components 210, 260 may be respective radiofrequency signal detectors. In still other embodiments, the signal 212 may be a Bluetooth signal, in which cases, the components 210, 260 may be respective Bluetooth signal detectors. In further embodiments, the components 210, 260 may be respective devices for detecting giant magnetoresistance (GMR) as the signal 212 associated with the phone 214. In other embodiments, the signal 212 may be other types of signals, and the components 210, 260 may be of a type that is configured to receive the signals. Also, in one or more embodiments, the hearing aid may be paired with the phone 214. The pairing may be performed automatically when the signal 212 associated with the phone 214 is detected by the hearing aid.

Also, in some embodiments, the communication devices 240, 290 may be transceivers (wherein each transceiver may include a transmitter and a receiver) that are configured to communicate with each other. For example, in some embodiments, the communication devices 240, 290 may be radiofrequency devices configured to communicate control signals 242, 292 in the form of radiofrequency signals. In other embodiments, the communication devices 240, 290 may be Bluetooth devices configured to communicate control signals 242, 292 in the form of Bluetooth signals. In further embodiments, the communication devices 240, 290 may be respective ends of a cable connecting the first and second hearing aids 12, 14. In such cases, the cable is configured to communicate the signals 242, 292 using physical wire(s).

In some embodiments, when the user places the phone 214 next to the first hearing aid 12 (first mode of operation), the first hearing aid 12 processes the conversational signals from the speaker of the phone 214 and output acoustic signals 232 representative of the conversational signals through the first speaker 230. In particular, the microphone 202 receives the conversational signals from the speaker of the phone 214 (which may be considered as an example of the environmental sound 204 in the example), and output corresponding electrical signals 206. The first processor 220 processes the electrical signals 206, and generates an output 222, which is then processed by the first speaker 230 to create the acoustic signals 232 representative of the conversational signals from the phone 214. In other embodiments, instead of using sound from the speaker of the phone 214, the first hearing aid 12 may be configured to detect an induction signal from the phone 214 that represents conversational signal. In such cases, the first hearing aid 12 may include an induction signal detector, which is configured to receive the induction signal representative of conversational signal. The induction signal detector provides an input to the first processor 220 based on the induction signal, and the first processor 220 then generates the output 222 to cause the speaker 230 to emit the acoustic signal 232 representative of the conversational signal from the phone 214. In further embodiments, when using the phone 214 with the first hearing aid 12, the phone 214 may be configured to transmit a radiofrequency signal or a Bluetooth signal representative of conversational signal from the phone 214. In such cases, the first hearing aid 12 may include a signal receiver (e.g., a radiofrequency receiver, or a Bluetooth receiver) configured to receive the radiofrequency/Bluetooth signal representative of conversational signal from the phone 214, and to generate an electrical signal in response thereto. The first processor 220 processes the electrical signal to generate the output 222, which is then processed by the first speaker 230 to output the acoustic signal 232 representative of the conversational signal from the phone 214. In some embodiments, the signal receiver at the first hearing aid 12 for receiving signal from the phone 214 representative of conversational signal may be implemented using the communication device 240, or a separate device.

In some embodiments, when the first hearing aid 12 is configured to use sound signal from the speaker of the phone 214 to provide the acoustic output 232, the microphone 202 may detect both conversational signal from the phone 214 as well as some environmental sound. In other embodiments in which the sound signal from the speaker of the phone 214 is not used by the first hearing aid 12 to provide the acoustic output 232 representative conversational signal from the phone 214, but a separate signal (e.g., an induction signal, a radiofrequency signal, a Bluetooth signal, etc., like that described in the previous embodiments) from the phone 214 is being used, the acoustic output 232 output by the first speaker 230 may represent both conversational signal from the phone 214 as well as sound from the environment. In such cases, the signal receiver at the first hearing aid 12 configured for receiving signal representative conversational signal from the phone 214 may provide a first input to the processor 220, and the microphone 202 may provide a second input representative of environmental sound 204 to the processor 220. The processor 220 processes the first and second inputs, and generates the output 222 the represent a combination of both phone conversational signal and environmental sound 204. The first speaker 230 processes the output 222 and generates the acoustic signal 232 that represent a combination of both phone conversational signal and environmental sound 204. In some embodiments, the ratio between the volume of conversational signal and the volume of environmental sound presented in the acoustic signal 232 may be fixed. In some cases, the ratio may be selected so that the conversational signal component in the acoustic signal 232 has a higher volume than the surrounding sound component. In other embodiments, the ratio may be adjustable through a control at the hearing aid 12/14 by the user. In other embodiments, when the first hearing aid 12 is processing signal from the phone 214, the first hearing aid 12 is configured to eliminate environmental sound 204. For example, the first hearing aid 12 may be configured to disable the microphone 202 in response to a detection of the signal 212 by the component 210 in some embodiments. In such cases, the first hearing aid 12 may further include a switch that switches between operations by the signal receiver and the microphone 202, respectively.

In the above embodiments, when the phone 214 is placed next to the first hearing aid 12, the second hearing aid 14 provides the acoustic signal 282 representative of the environmental sound 254, and does not represent any phone conversational signal from the phone 214. In other embodiments, in response to the control signal 242 received from the first hearing aid 12, the second hearing aid 14 may be configured to provide the acoustic signal 282 representative of both phone conversational signal from the phone 214, and environmental sound 254. For example, the first hearing aid 12 may transmit a signal representative of the conversational signal from the phone 214 to the second hearing aid 14 (e.g., using the first communication device 240, or another communication device at the first hearing aid 12). In such cases, the second communication device 290 of the second hearing aid 14 receives the signal, and generates a first input for the second processor 270 in response thereto for processing by the second processor 270. The second processor 270 also receives a second input from the second microphone 252 representative of environmental sound 254. The processor 270 processes the first and second inputs, and generates the output 272 that represent a combination of both phone conversational signal and environmental sound. The second speaker 280 processes the output 272 and generates the acoustic signal 282 that represent a combination of both phone conversational signal and environmental sound. In some embodiments, the ratio between the volume of conversational signal and the volume of environmental sound presented in the acoustic signal 282 may be fixed. In other embodiments, the ratio may be adjustable through a control at the hearing aid 12/14 by the user.

In other embodiments, instead of placing the phone 214 next to the first hearing aid 12, the user may place the phone 214 next to the second hearing aid 14 (first mode of operation). In such cases, the second hearing aid 14 processes the conversational signals from the speaker of the phone 214 and output acoustic signals 282 representative of the conversational signals through the second speaker 280. In particular, the microphone 252 receives the conversational signals from the speaker of the phone 214 (which may be considered as an example of the environmental sound 254 in the example), and output corresponding electrical signals 256. The second processor 270 processes the electrical signals 256, and generates an output 272, which is then processed by the second speaker 280 to create the acoustic signals 282 representative of the conversational signals from the phone 214. In other embodiments, instead of using sound from the speaker of the phone 214, the second hearing aid 14 may be configured to detect an induction signal from the phone 214 that represents conversational signal. In such cases, the second hearing aid 14 may include an induction signal detector, which is configured to receive the induction signal representative of conversational signal. The induction signal detector provides an input to the second processor 270 based on the induction signal, and the second processor 270 then generates the output 272 to cause the speaker 280 to emit the acoustic signal 282 representative of the conversational signal from the phone 214. In further embodiments, when using the phone 214 with the second hearing aid 14, the phone 214 may be configured to transmit a radiofrequency signal or a Bluetooth signal representative of conversational signal from the phone 214. In such cases, the second hearing aid 14 may include a signal receiver (e.g., a radiofrequency receiver, or a Bluetooth receiver) configured to receive the radiofrequency/Bluetooth signal representative of conversational signal from the phone 214, and to generate an electrical signal in response thereto. The second processor 270 processes the electrical signal to generate the output 272, which is then processed by the second speaker 280 to output the acoustic signal 282 representative of the conversational signal from the phone 214. In some embodiments, the signal receiver at the second hearing aid 14 for receiving signal from the phone 214 representative of conversational signal may be implemented using the communication device 290, or a separate device.

In some embodiments, when the second hearing aid 14 is configured to use sound signal from the speaker of the phone 214 to provide the acoustic output 282, the microphone 252 may detect both conversational signal from the phone 214 as well as some environmental sound. In other embodiments in which the sound signal from the speaker of the phone 214 is not used by the second hearing aid 14 to provide the acoustic output 282 representative conversational signal from the phone 214, but a separate signal (e.g., an induction signal, a radiofrequency signal, a Bluetooth signal, etc., like that described in the previous embodiments) from the phone 214 is being used, the acoustic output 282 output by the first speaker 280 may represent both conversational signal from the phone 214 as well as sound 254 from the environment. In such cases, the signal receiver at the second hearing aid 14 configured for receiving signal representative conversational signal from the phone 214 may provide a first input to the processor 270, and the microphone 252 may provide a second input representative of environmental sound 254 to the second processor 270. The second processor 270 processes the first and second inputs, and generates the output 272 the represent a combination of both phone conversational signal and environmental sound 254. The second speaker 280 processes the output 272 and generates the acoustic signal 282 that represent a combination of both phone conversational signal and environmental sound 254. In some embodiments, the ratio between the volume of conversational signal and the volume of environmental sound presented in the acoustic signal 282 may be fixed. In some cases, the ratio may be selected so that the conversational signal component in the acoustic signal 282 has a higher volume than the surrounding sound component. In other embodiments, the ratio may be adjustable through a control at the hearing aid 12/14 by the user. In other embodiments, when the second hearing aid 14 is processing signal from the phone 214, the second hearing aid 14 is configured to eliminate environmental sound 204. For example, the second hearing aid 14 may be configured to disable the microphone 252 in response to a detection of the signal 212 by the component 260 in some embodiments. In such cases, the second hearing aid 14 may further include a switch that switches between operations by the signal receiver and the microphone 252, respectively.

In the above embodiments, when the phone 214 is placed next to the second hearing aid 14, the first hearing aid 12 provides the acoustic signal 232 representative of the environmental sound 204, and does not represent any phone conversational signal from the phone 214. In other embodiments, in response to the control signal 292 received from the second hearing aid 14, the first hearing aid 12 may be configured to provide the acoustic signal 232 representative of both phone conversational signal from the phone 214, and environmental sound 204. For example, the second hearing aid 14 may transmit a signal representative of the conversational signal from the phone 214 to the first hearing aid 12 (e.g., using the first communication device 290, or another communication device at the second hearing aid 14). In such cases, the first communication device 240 of the first hearing aid 12 receives the signal, and generates a first input for the first processor 220 in response thereto for processing by the first processor 220. The first processor 220 also receives a second input from the first microphone 202 representative of environmental sound 204. The processor 220 processes the first and second inputs, and generates the output 222 that represent a combination of both phone conversational signal and environmental sound 204. The first speaker 230 processes the output 222 and generates the acoustic signal 232 that represent a combination of both phone conversational signal and environmental sound 204. In some embodiments, the ratio between the volume of conversational signal and the volume of environmental sound presented in the acoustic signal 232 may be fixed. In other embodiments, the ratio may be adjustable through a control at the hearing aid 12/14 by the user.

In one or more embodiments, when the phone 214 next to the first hearing aid 12 is removed, the component 210 does not receive or detect the signal 212 that is associated with the phone 214. In such cases, in response to the lack of reception or detection of the signal 212 by the component 210, the communication device 240 transmits an additional control signal to the second hearing aid 14. The communication device 290 of the second hearing aid 14 receives the additional control signal, and in response to the additional control signal, the second processor 270 increases the gain of the second hearing aid 14. Because the gain of the second hearing aid 14 was previously reduced to a non-zero value when the phone 214 was placed next to the first hearing aid 12, in some embodiments, when the phone 214 is removed, the gain of the second hearing aid 14 is increased from the non-zero value to a higher value. The higher value may be a preset value in some embodiments. In other embodiments, the higher value may be dynamically determined based on the environment in which the hearing system 10 is being operated. Also, in some embodiments, the higher value may be based on a hearing loss of the user of the hearing system 10, and may be determined based on a hearing loss compensation algorithm stored in the hearing system 10.

Also, in one or more embodiments described herein the first hearing aid 12 and/or the second hearing aid 14 may also include a control for allowing a user of the hearing system 10 to turn "ON" or "OFF" the gain reduction feature. In such cases, if the gain reduction feature is turned "ON", the hearing system 10 will automatically reduce a gain of one of the hearing aids 12, 14 to a non-zero value in response to the other one of the hearing aids 12, 14 detecting the signal 212 associated with the phone 214. On the other hand, if the gain reduction feature is turned "OFF", the hearing system 10 will not automatically reduce a gain of one of the hearing aids 12, 14 to a non-zero value in response to the other one of the hearing aids 12, 14 detecting the signal 212 associated with the phone 214. In such cases, if the hearing system 10 includes a control for allowing the user to selectively reduce the volume of one or both of the hearing aids 12, 14, the user may manually adjust the volume of one hearing aid while the other hearing aid is used with the phone 214.

Figure 4:
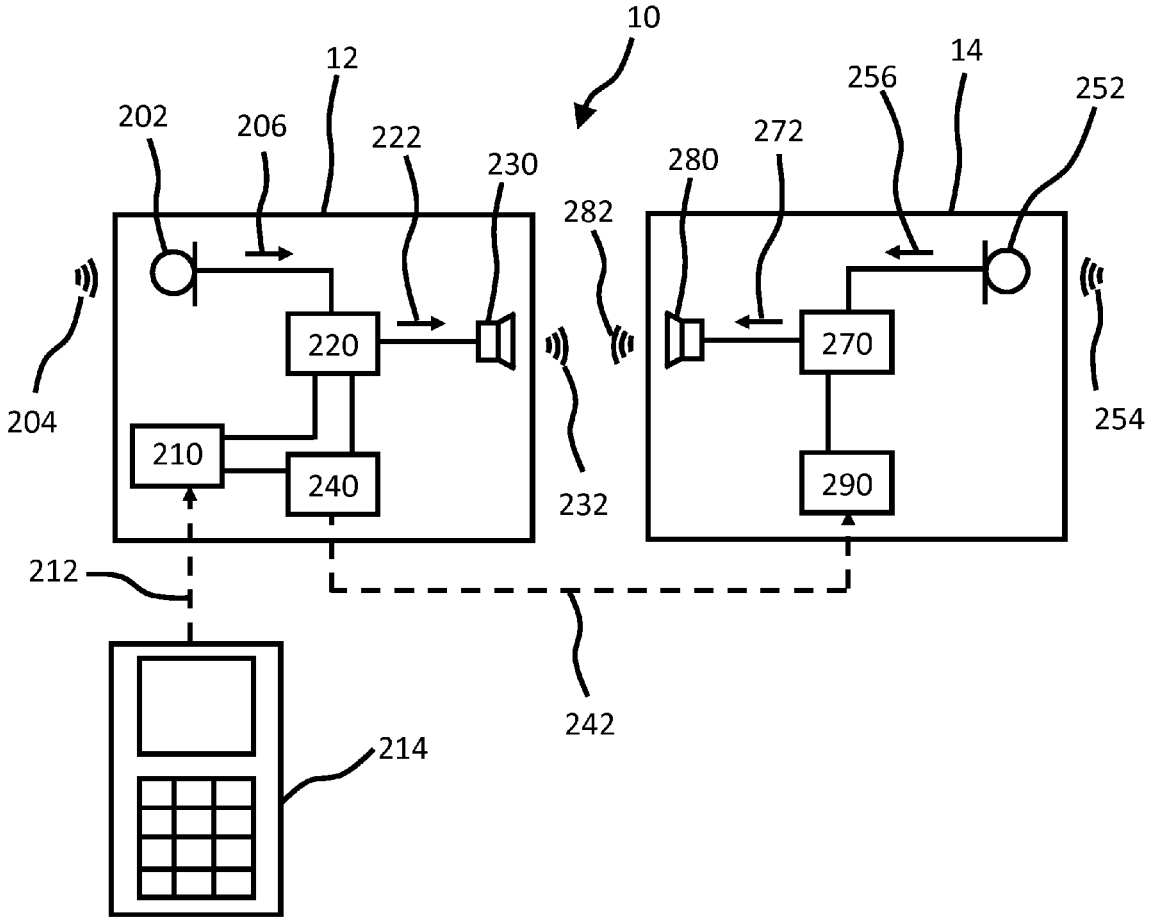
FIG. 4 illustrates another implementation of the binaural hearing system of FIG. 1 in accordance with other embodiments.

In the above embodiments, the hearing system 10 is configured so that the phone 214 may be selectively placed next to one of the first hearing aid 12 and the second hearing aid 14, and the other one of the hearing aids 12, 14 would reduce the gain accordingly. In other embodiments, such as that shown in FIG. 4, the hearing system 10 may be configured so that only one of the hearing aids 12, 14 is configured to process conversational signal from the phone 214. In the illustrated embodiments, only the first hearing aid 12 has the component 210 for detecting the signal 212 associated with the phone 214, and the second hearing aid 14 does not have the component 260 for detecting the signal 212. Alternatively, the hearing aid 14 may optionally further include the component 260 like that shown in the embodiments of FIG. 2. Also, in the illustrated embodiments, the first communication device 240 is a transmitter, and the second communication device 290 is a receiver. The method of using the hearing system 10 of FIG. 4 is the same as that described previously, except that only the first hearing aid 12 is configured to detect the signal 212 from the phone 214. The hearing system 10 of FIG. 4 may be advantageous in that it reduces the complexity of the configuration of the second hearing aid 14, and it may be beneficial for users who have an ear-preference for talking on the phone.

In further embodiments, the component 210/260 for detecting the signal 212 associated with the phone 214 may be implemented at an intermediary device that is configured to communicate with both the phone 214 and the hearing aids 12, 14. In such cases, the intermediary device may include a first communication device (e.g., a wire, a wireless transceiver, etc.) for communication with the phone 214, and a second communication device (e.g., a wire, a wireless transceiver, etc.) for communication with the hearing aids 12, 14. The intermediary device may further include a processor for processing signals transmitted from the phone 214 and the hearing aids 12, 14. In some embodiments, the intermediary device may be a head-band, a neck-band, or any of other devices that can be worn by the user. In other embodiments, the intermediary device may include a clip for detachably coupling to a clothing of the user.

During use, when the component 210/260 at the intermediary device detects the signal 212 associated with the phone 214 (thereby indicating that the user may be using the phone 214), the intermediary device that transmits control signal(s) to one or both of the hearing aids 12, 14 to bring the hearing aid 12 and/or the hearing aid 14 into the second mode of operation. In some embodiments, in the second mode of operation, the intermediary device provides conversational signal received from the phone 214 to one or both of the hearing aids 12, 14. For example, in some embodiments, the intermediary device may provide conversational signal to only the first hearing aid 12, while reducing a gain of the second hearing aid 12 (which may be achieved by the intermediary device transmitting a control signal to the second hearing aid 12 to reduce the gain). In such cases, the second hearing aid 12 continues to provide acoustic signal to the user representing the environmental sound. In some embodiments, the first hearing aid 12 receives the conversational signal from the intermediary device, and presents the acoustic signal 232 to the user that represents only the conversational signal from the phone 214. In other embodiments, the first hearing aid 12 may be configured to mix the conversational signal received from the intermediary device with signal representing surrounding sound 204 output by the microphone 202, and present the acoustic signal 232 that represents both conversational signal from the phone 214 and the surrounding sound 204. In some cases, the conversational signal component in the acoustic signal 232 may have a higher volume than the surrounding sound component.

In further embodiments, the intermediary device may provide conversational signal received from the phone 214 to both the first and second hearing aids 12, 14. In such cases, one or both of the hearing aids 12, 14 may be configured to mix the conversational signal with signal representing surrounding sound detected by the corresponding microphone(s) 202 and/or 252. In some cases, the conversational signal component in the acoustic signal 232 and/or 282 provided from the corresponding microphone 202 and/or 252 may have a higher volume than the surrounding sound component.

In one or more embodiments, a hearing aid fitting system may be provided for fitting the hearing system 10 to compensate for a hearing loss of a user of the hearing system 10. In some embodiments, the hearing aid fitting system may include a user interface (e.g., a keyboard, a touch-screen, a button, a knob, a microphone for receiving verbal command, etc.) for receiving an input to set an amount of gain reduction of each of the first hearing aid and the second hearing aid. The amount of gain reduction may be different between the first and second hearing aids. In some embodiments, the amount of gain reduction of each of the first and second hearing aids may be based on a hearing loss of the user.

In one or more embodiments, a hearing aid may be configured to detect whether it is located at a position contralateral (relating to or denoting the opposite side of a body) to a position of the phone with respect to a head of a user. The hearing aid may be one of the hearing aids in a binaural hearing aid system, or alternatively, it may be a stand-alone single hearing aid. For example, in accordance with other embodiments, a hearing aid may include (1) a microphone for converting sound into electrical signals; (2) a processor communicatively coupled to the microphone, wherein the processor is configured to provide an output based on the electrical signals from the microphone; (3) a speaker communicatively coupled to the processor, and is configured to provide an acoustic signal based on the output provided by the processor; and (4) a communication device configured to receive a control signal transmitted from a phone or a phone accessory. The processor may be configured to reduce a gain of the hearing aid to a non-zero value in response to the control signal received from the phone or the phone accessory. By means of non-limiting examples, the phone accessory may be a Bluetooth bridging device. Such hearing aid may be configured to detect whether it is located at a position contralateral to a position of the phone with respect to a head of a user. For example, in some embodiments, the hearing aid may include a detector for detecting a signal associated with the phone (e.g., a signal coming from the phone). If the detected signal has a signal strength that is below a threshold, then the hearing aid may determine that the hearing aid is contralateral to the position of the phone (i.e., the phone is at the ear that is different from the ear at which the hearing aid is located). On the other hand, if the detected signal has a signal strength above the threshold, the hearing aid may determine that the hearing aid is not contralateral to the position of the phone (i.e., the phone and the hearing aid are both at the same ear).

In some embodiments, the reduction of the gain of the hearing aid may be based on whether the hearing aid is located at a position contralateral to a position of the phone with respect to the head of the user. For example, in some embodiments, if the hearing aid is located at a position contralateral to a position of the phone with respect to the head of the user, the processor may reduce the gain of the hearing aid by a first amount, and if the hearing aid is not located at a position contralateral to a position of the phone with respect to the head of the user, the processor may reduce the gain of the hearing aid by a second amount that is different from the first amount.

In some embodiments, the first amount may be greater than the second amount. For example, in some embodiments in which the hearing aid is configured to receive acoustic signal from the phone, and if the phone is placed at the same ear at which the hearing aid is located, then the second amount of gain reduction may be less than the first amount. This is because when the user is using the ear with hearing condition for listening to phone conversation, it would be desirable to not reduce the gain of the hearing aid too much. On the other hand, if the user is using the good ear for listening to phone conversation, then it may be desirable to reduce the gain of the hearing aid at the other ear (the one with the hearing aid) more so that the user can better listen to the phone conversation.

In other embodiments, the first amount of gain reduction may be less than the second amount of gain reduction. For example, in some embodiments in which the hearing aid is configured to receive non-acoustic signal from the phone (e.g., induction signal, or other types of signal that is not from the speaker), and if the phone is placed at the same ear at which the hearing aid is located, then the second amount of gain reduction (for the environmental sound component, not the phone signal component) may be more than the first amount. This is because when the user is using the ear with hearing condition for listening to phone conversation, it would be desirable to reduce the volume of the environmental sound processed by the hearing aid, so that the user of the hearing aid can listen to the phone conversation that is also provided by the hearing aid.

In further embodiments, the first amount of gain reduction may be the same as the second amount of gain reduction.

In still further embodiments, if the hearing aid detects that it is located at a position contralateral to a position of the phone with respect to the head of the user, then the processor automatically reduces the gain of the hearing aid. If the hearing aid detects that it is not located at a position contralateral to a position of the phone (i.e., the hearing aid and the phone are at the same ear), then the processor does not reduce the gain of the hearing aid.

In one or more embodiments described herein, the gain of a hearing aid that is reduced may be the gain from the microphone to the speaker of the hearing aid.

Also, in one or more embodiments described herein, the amount of gain adjustment may be adjustable. For example, the amount of gain reduction may be adjustable by a user using a control at one or both of the first and second hearing aids. In another example, the amount of gain reduction may be adjustable by a technician during a hearing aid fitting process. In such cases, the amount of gain reduction may be adjustable and preset to a certain value.

It should be noted that the terms "first" and "second", as used in this specification, are used to refer to multiple things. For example, the term "first hearing aid" and the term "second hearing aid" are used to refer to two hearing aids. Also, the term "first hearing aid" and the term "second hearing aid" may be used interchangeably. For example, in other embodiments, hearing aid 14 may be considered a "first hearing aid", and hearing aid 12 may be considered a "second hearing aid".

Also, as used in this specification, a signal described as being provided from a component may be output directly from the component, or may be derived from an output from the component. For example, the signal 222 from the first processor 220 may be considered as being output directly from the processor 220, or derived from an output from the processor 220 (e.g., after the output from the processor 220 is further processed by another component coupled to the processor 220).

Although particular embodiments have been shown and described, it will be understood that they are not intended to limit the claimed inventions, and it will be obvious to those skilled in the art that various changes and modifications may be made without departing from the spirit and scope of the claimed inventions. The specification and drawings are, accordingly, to be regarded in an illustrative rather than restrictive sense. The claimed inventions are intended to cover alternatives, modifications, and equivalents.

What is claimed:

1. A hearing system comprising a first hearing aid, the first hearing aid comprising:

a first microphone for converting sound into electrical signals;

a processor communicatively coupled to the first microphone, wherein the processor is configured to provide an output based on the electrical signals from the first microphone;

a first speaker communicatively coupled to the processor, and is configured to provide an acoustic signal based on the output provided by the processor; and a first communication device configured to receive a control signal transmitted from a second hearing aid in response to a reception or detection of a signal associated with a phone by the second hearing aid;

wherein the first hearing aid is configured to reduce a gain of the first hearing aid to a non-zero value in response to the control signal received from the second hearing aid, the reduced gain of the first hearing aid being different from a gain of the second hearing aid.

2. The hearing system of claim 1, wherein the first hearing aid is configured to be switched to an omnidirectional mode in response to the control signal.

3. The hearing system of claim 1, wherein the first microphone of the first hearing aid remains on after the first communication device of the first hearing aid receives the control signal from the second hearing aid.

4. The hearing system of claim 1, wherein the first speaker of the first hearing aid is configured to provide the acoustic signal based on the output provided by the processor regardless of whether the first communication device of the first hearing aid receives the control signal from the second hearing aid or not.

5. The hearing system of claim 1, wherein the first hearing aid is configured to provide acoustic signals representative of phone signals from the phone in response to the control signal received from the second hearing aid.

6. The hearing system of claim 1, further comprising the second hearing aid, wherein in response to the signal associated with the phone, only the second hearing aid, and not the first hearing aid, provides acoustic signals representative of phone signals from the phone.

7. The hearing system of claim 1, wherein an amount of gain reduction is adjustable.

8. The hearing system of claim 1, further comprising a control for allowing a user of the hearing system to adjust an amount of gain reduction of the first hearing aid.

9. The hearing system of claim 1, wherein an amount of gain reduction of the first hearing aid is based on a preset user preference.

10. The hearing system of claim 1, wherein an amount of gain reduction of the first hearing aid is based on a hearing loss of a user of the hearing system.

11. The hearing system of claim 1, wherein an amount of gain reduction of the first hearing aid is dependent on an environment in which the hearing system is operated.

12. The hearing system of claim 1, wherein an amount of gain reduction of the first hearing aid is frequency dependent.

13. The hearing system of claim 1, wherein the first communication device comprises a wire for receiving the control signal.

14. The hearing system of claim 1, wherein the first communication device comprises a wireless component for receiving the control signal.

15. The hearing system of claim 1, further comprising the second hearing aid, the second hearing aid comprising:

a component for receiving or detecting the signal associated with the phone; and a second communication device communicatively coupled to the component, wherein the second communication device is configured to transmit the control signal to the first hearing aid in response to the signal received or detected by the component.

16. The hearing system of claim 15, wherein the component comprises a sensor for detecting a magnetic field as the signal that is associated with the phone.

17. The hearing system of claim 16, wherein the magnetic field is from a permanent magnet.

18. The hearing system of claim 16, wherein the magnetic field is from an electro-magnetic coil.

19. The hearing system of claim 15, wherein the component comprises a signal receiver configured to receive radiofrequency signal from the phone.

20. The hearing system of claim 15, wherein the component comprises a signal receiver configured to receive Bluetooth signal from the phone.

21. The hearing system of claim 15, wherein the second hearing aid is configured to operate in a first mode and in a second mode, the second hearing aid having a second speaker;

wherein in the first mode, the second speaker of the second hearing aid provides an acoustic signal that represents environmental sound; and wherein in the second mode, the second speaker of the second hearing aid provides an acoustic signal that represents phone signal.

22. The hearing system of claim 21, wherein when in the second mode, the acoustic signal that represents the phone signal is derived from an acoustic phone signal provided from a speaker of the phone.

23. The hearing system of claim 21, wherein when in the second mode, the acoustic signal that represents the phone signal is derived from an induction signal from the phone.

24. The hearing system of claim 1, wherein the first hearing aid is also configured to increase the gain of the first hearing aid in response to an additional control signal transmitted by the second hearing aid, the additional control signal transmitted by the second hearing aid in response to a lack of reception or detection of the signal associated with the phone.

25. A hearing aid fitting system for fitting the hearing system of claim 1 to compensate for a hearing loss of a user, comprising a user interface for receiving an input to set an amount of gain reduction of the first hearing aid.

26. A hearing system comprising a first hearing aid, the first hearing aid comprising:

a first microphone for converting sound into electrical signals;

a component for receiving or detecting a signal associated with a phone;

a processor communicatively coupled to the first microphone, wherein the processor is configured to provide an output based on the electrical signals from the first microphone;

a first speaker communicatively coupled to the processor, and is configured to provide an acoustic signal based on the output provided by the processor; and a first communication device communicatively coupled to the component, wherein the communication device is configured to transmit a control signal to a second hearing aid to reduce a gain of the second hearing aid to a non-zero value in response to the signal received or detected by the component, the reduced gain of the second hearing aid being different from a gain of the first hearing aid.

27. The hearing system of claim 26, further comprising the second hearing aid, wherein the second hearing aid comprises:

a second communication device configured to receive the control signal transmitted from the first communication device of the first hearing aid; and circuitry for reducing the gain of the second hearing aid in response to the control signal.

28. The hearing system of claim 26, wherein the control signal also switches the second hearing aid into an omnidirectional mode.

29. The hearing system of claim 28, further comprising the second hearing aid, wherein the second hearing aid comprises:

a second communication device configured to receive the control signal transmitted from the first communication device of the first hearing aid; and circuitry for reducing the gain of the second hearing aid in response to the control signal, and for switching the second hearing aid into the omnidirectional mode in response to the control signal.

30. The hearing system of claim 26, further comprising the second hearing aid, the second hearing aid comprising a second microphone and a second speaker, wherein the second microphone of the second hearing aid remains on after the second hearing aid receives the control signal from the first hearing aid.

31. The hearing system of claim 26, further comprising the second hearing aid, the second hearing aid comprising a second microphone and a second speaker, wherein the second speaker of the second hearing aid is configured to provide an acoustic signal based on an output from the second microphone regardless of whether the second hearing aid receives the control signal from the first hearing aid or not.

32. The hearing system of claim 26, further comprising the second hearing aid, wherein the second hearing aid is configured to provide acoustic signals representative of phone signals from the phone in response to the control signal received from the first hearing aid.

33. The hearing system of claim 26, further comprising the second hearing aid, wherein in response to the signal associated with the phone, only the first hearing aid, and not the second hearing aid, provides acoustic signals representative of phone signals from the phone.

34. The hearing system of claim 26, wherein an amount of gain reduction of the second hearing aid is adjustable.

35. The hearing system of claim 26, further comprising a control for allowing a user of the hearing system to adjust an amount of gain reduction of the second hearing aid.

36. The hearing system of claim 26, wherein an amount of gain reduction of the second hearing aid is based on a preset user preference.

37. The hearing system of claim 26, wherein an amount of gain reduction of the second hearing aid is based on a hearing loss of a user of the hearing system.

38. The hearing system of claim 26, wherein an amount of gain reduction of the second hearing aid is dependent on an environment in which the hearing system is operated.

39. The hearing system of claim 26, wherein an amount of gain reduction of the second hearing aid is frequency dependent.

40. The hearing system of claim 26, wherein the component comprises a sensor for detecting a magnetic field as the signal that is associated with the phone.

41. The hearing system of claim 40, wherein the magnetic field is from a permanent magnet.

42. The hearing system of claim 40, wherein the magnetic field is from an electro-magnetic coil.

43. The hearing system of claim 26, wherein the component comprises a signal receiver configured to receive radiofrequency signal from the phone.

44. The hearing system of claim 26, wherein the component comprises a signal receiver configured to receive Bluetooth signal from the phone.

45. The hearing system of claim 26, wherein the first communication device comprises a wire for transmitting the control signal.

46. The hearing system of claim 26, wherein the first communication device comprises a wireless component for transmitting the control signal.

47. The hearing system of claim 26, wherein the first hearing aid is configured to operate in a first mode and in a second mode;

wherein in the first mode, the first speaker provides the acoustic signal that represents environmental sound; and wherein in the second mode, the first speaker provides an output that represents phone signal.

48. The hearing system of claim 47, wherein when in the second mode, the output that represents the phone signal is derived from an acoustic phone signal provided from a speaker of the phone.

49. The hearing system of claim 47, wherein when in the second mode, the output that represents the phone signal is derived from an induction signal from the phone.

50. The hearing system of claim 26, wherein the first communication device of the first hearing aid is also configured to transmit an additional control signal to the second hearing aid to increase the gain of the second hearing aid in response to a lack of reception or detection of the signal associated with the phone.

51. A hearing aid fitting system for fitting the hearing system of claim 26 to compensate for a hearing loss of a user, comprising a user interface for receiving an input to set an amount of gain reduction of the second hearing aid.

52. A hearing system comprising a first hearing aid, the first hearing aid comprising:

a first microphone for converting sound into electrical signals;

a processor communicatively coupled to the first microphone, wherein the processor is configured to provide an output based on the electrical signals from the first microphone;

a first speaker communicatively coupled to the processor, and is configured to provide an acoustic signal based on the output provided by the processor; and a first communication device configured to receive a control signal transmitted from a second hearing aid in response to a lack of reception or detection of a signal associated with a phone;

wherein the first hearing aid is configured to increase a gain of the first hearing aid in response to the control signal received from the second hearing aid, the increased gain of the first hearing aid being different from a gain of the second hearing aid.

53. A hearing system comprising a first hearing aid, the first hearing aid comprising:

a first microphone for converting sound into electrical signals;

a component for receiving or detecting a signal associated with a phone;

a processor communicatively coupled to the first microphone, wherein the processor is configured to provide an output based on the electrical signals from the first microphone;

a first speaker communicatively coupled to the processor, and is configured to provide an acoustic signal based on the output provided by the processor; and a first communication device communicatively coupled to the component, wherein the communication device is configured to transmit a control signal to a second hearing aid to increase a gain of the second hearing aid in response to a lack of reception or detection of the signal associated with the phone by the component, the increased gain of the second hearing aid being different from a gain of the first hearing aid.

54. A hearing aid comprising:

a microphone for converting sound into electrical signals;

a processor communicatively coupled to the microphone, wherein the processor is configured to provide an output based on the electrical signals from the microphone;

a speaker communicatively coupled to the processor, and is configured to provide an acoustic signal based on the output provided by the processor; and a communication device configured to receive a control signal transmitted from a phone or a phone accessory;

wherein the hearing aid is configured to detect whether it is located at a position contralateral to a position of the phone with respect to a head of a user; and wherein the processor is configured to reduce a gain of the hearing aid to a non-zero value in response to the control signal received from the phone or the phone accessory, wherein the hearing aid is a part of a binaural hearing aid system that includes an additional hearing aid, the reduced gain of the hearing aid being different from a gain of the additional hearing aid.

55. The hearing aid of claim 54, wherein the control signal is from the phone accessory, and the phone accessory comprises a Bluetooth bridging device.

* * * * *